US006195052B1

(12) United States Patent
Neoh et al.

(10) Patent No.: US 6,195,052 B1
(45) Date of Patent: Feb. 27, 2001

(54) RADIO COMMUNICATION DEVICE

(75) Inventors: Kim Koon Neoh, Kedah; Say Hock Lim, Penang, both of (MY)

(73) Assignee: Motorola Electronics SDN BHD, Penang (MY)

( * ) Notice: Subject to any disclaimer, the term of this patent is extended or adjusted under 35 U.S.C. 154(b) by 0 days.

(21) Appl. No.: 09/247,962

(22) Filed: Feb. 10, 1999

(51) Int. Cl.[7] ..... H01Q 1/24
(52) U.S. Cl. ..... 343/702; 343/906; 455/90
(58) Field of Search ..... 343/702, 700 MS, 343/906, 900; 455/90; H01Q 1/24

(56) References Cited

U.S. PATENT DOCUMENTS 5,852,421 * 12/1998 Maldonado ..... 343/713
5,861,854 * 1/1999 Kawahata et al. ..... 343/702
5,969,685 * 10/1999 Hayes et al. ..... 343/702
5,986,607 * 11/1999 Rudisill ..... 343/702
6,028,568 * 2/2000 Asakura et al. ..... 343/702

* cited by examiner

*Primary Examiner*—Hoanganh Le
(74) *Attorney, Agent, or Firm*—Dale W. Dorinski

(57) ABSTRACT

A radio communication device (10) has a controller (11), an antenna mount (12), a reference voltage source (13), a voltage bias supply (14), transceiver circuitry (15) and an annunciator (16). Device (10) also has an antenna (17) that is detachably mounted to antenna mount (12). The base of antenna (17) has a conductive track (19) which is selectively insulated. Uninsulated portions of conductive track (19) connects electrical contacts on antenna mount (12) such that a code signal can be provided on signal lines connecting antenna mount (12) to controller (11). The electrical contacts are distributed on a contact housing (30) of antenna mount (12). In response to the code signal, controller (11) controls annunciator (16) to provide an indication to a user of device (10) whether antenna (17) is selected appropriately or improperly connected. The code signal is provided independent of radiofrequency signals received or transmitted via transceiver circuitry (15).

5 Claims, 3 Drawing Sheets

RADIO COMMUNICATION DEVICE

FIELD OF THE INVENTION

This invention relates to radio communication devices. In particular, this invention relates to, but is not necessarily limited to, a radio communication device using an antenna for transmitting or receiving radio frequency (RF) signals.

BACKGROUND OF THE INVENTION

Radio communication devices are known to operate with antennae for transmitting or receiving radio frequency (RF) signals within a communication environment. Typically, these antennae are designed to transmit or receive the signals found within desired bandwidths of RF frequencies. As a result, signals not found within the desired bandwidths are not transmitted or received as efficiently.

As is known in the art of antenna design, impedance mismatch between an antenna and circuitry of a radio communication device causes a loss in the power of a signal being transmitted or received. For a transmitted signal, reflection of such a signal back to the circuitry typically accounts for some of the loss. Generally, reflected power of a transmitted signal does not cause any problems when its magnitude is small relative to the magnitude of what is transmitted. However, when the impendance mismatch exceeds a tolerable limit, the reflected power may damage sensitive components of the circuitry.

For radio communication devices with detachable antennae, mismatch conditions due to improper antenna connection or absence of a required antenna can also cause problems of reflected power. Typically, the absence of an antenna results in an open circuit mismatch condition where a transmitted signal is totally reflected. Consequently, this open circuit mismatch condition can seriously damage sensitive components. In the absence of feedback to users, these mismatch conditions may cause the user to perceive incorrectly that a radio communication device is faulty.

SUMMARY OF THE INVENTION

It is an object of this invention to overcome or at least alleviate at least one of the problems associated with radio communication devices using antennae.

According to one aspect of the invention, there is provided a radio communication device, said device comprising:

a controller; and an antenna mount having a plurality of electrical contacts, at least one of said electrical contacts being coupled to said controller and at least one other of said electrical contacts being coupled to a reference voltage.

According to another aspect of the invention, there is provided an antenna for a radio communication device, said antenna comprising:

at least one conductive track, said conductive track being for connecting at least some of a plurality of electrical contacts of said device.

BRIEF DESCRIPTION OF THE DRAWINGS

In order to describe the invention and to put it into practical effect, reference will now be made to preferred embodiments as illustrated with reference to the accompanying drawings in which.

DETAILED DESCRIPTION OF THE INVENTION

Figure 1:
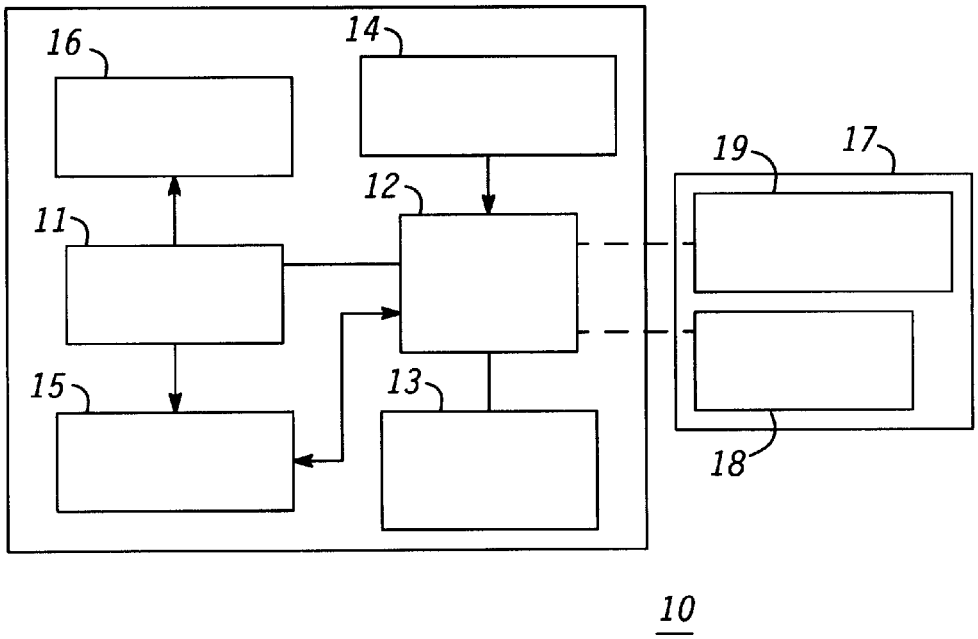
FIG. 1 is a block diagram of a radio communication device in accordance with a preferred embodiment of the invention.

FIG. 1 is a block diagram of a radio communication device 10 in accordance with a preferred embodiment of the invention. Device 10 comprises a controller 11, an antenna mount 12, a reference voltage source 13, a voltage bias supply 14, transceiver circuitry 15 and an annunciator 16. Device 10 further comprises an antenna 17 which is connectable to antenna mount 12. Antenna 17 has a signal core 18 and a conductive track 19.

Figure 2:
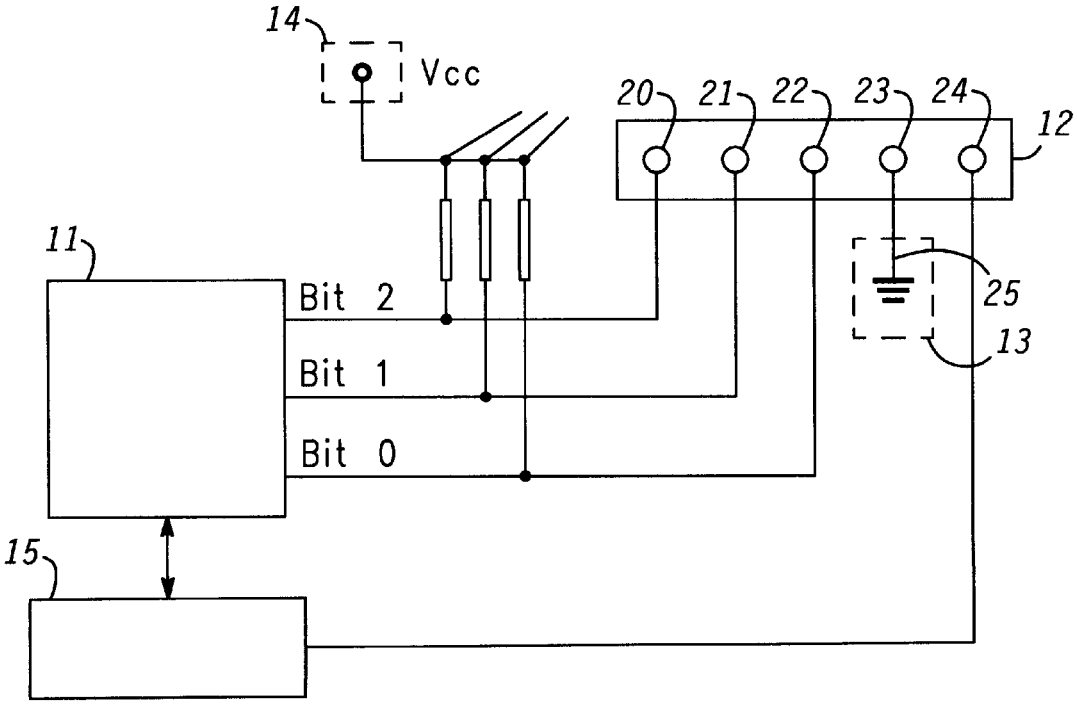
FIG. 2 shows signal coupling between a controller and an antenna mount within the radio communication device of FIG. 1.

Signal coupling between controller 11 and antenna mount 12 is schematically shown in FIG. 2. Antenna mount 12 has a plurality of electrical contacts 20, 21, 22, 23, 24. Three signal lines 'Bit 2', 'Bit 1' and 'Bit 1' of controller 11 respectively couples to three of the electrical contacts 20,21, 22. Electrical contact 23 connects to reference voltage source 13. In this preferred embodiment, reference voltage source 13 is a ground reference 25. Signal core 18 connects to electrical contact 24 which conducts signals transmitted or received by transceiver circuitry 15 for device 10.

Figure 3:
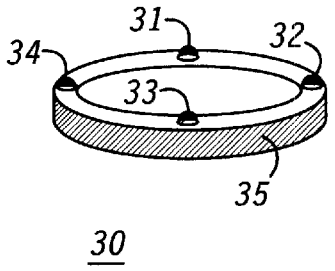
FIG. 3 is an isometric view of a contact housing for an antenna mount of the radio communication device of FIG. 1.
Figure 4:
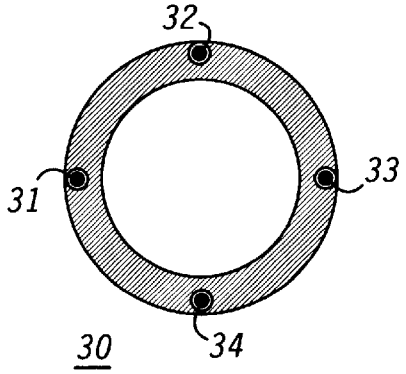
FIG. 4 is a top view of the contact housing of FIG. 3.

An isometric view and a top view of a contact housing 30 for antenna mount 12 is shown in FIGS. 3 and 4 respectively. In the preferred embodiment of this invention, electrical contacts 20,21,22,23 are, respectively, spring plunger contacts 31,32,33,34 disposed on contact housing 30. However, it is to be noted that other mechanisms for electrical contacts 20,21,22,23 may be adapted to function in the same manner as these spring plunger contacts 31,32,33,34.

Figure 5:
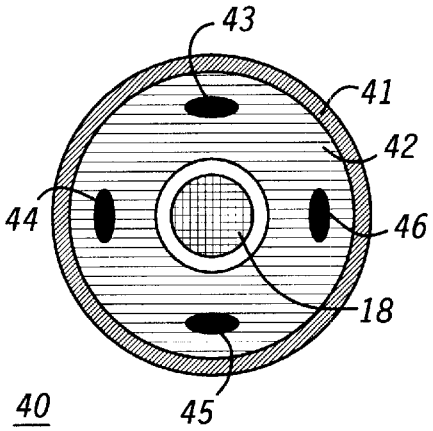
FIGS. 5 and 6 are radial cross-sections of the base of two embodiments of an antenna for the radio communication device of FIG. 1.
Figure 6:
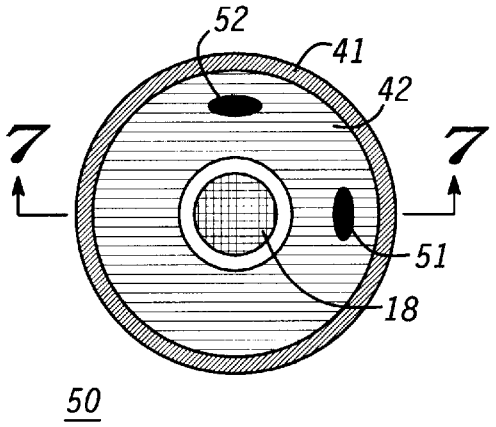

FIGS. 5 and 6 are radial cross-sections of the base of two embodiments 40,50 of antenna 17. For both embodiments 40,50, an outer support 41 surrounds an insulation media 42. Conductive track 19 is disposed within insulation medium 42 and selectively insulated to provide a plurality of uninsulated portions. Four uninsulated portions 43,44,45,46 are shown for embodiment 40. Embodiment 50 has two uninsulated portions 51,52. Surrounding signal core 18 in both embodiments 40,50 is a gap for connecting to electrical contact 24 of antenna mount 12.

Although the mechanism for mounting antenna 17 to antenna mount 12 is not shown, such a mechanism is well known in the art. For example, detachable antennae typically connect to radio communication devices by threaded screws.

Figure 7:
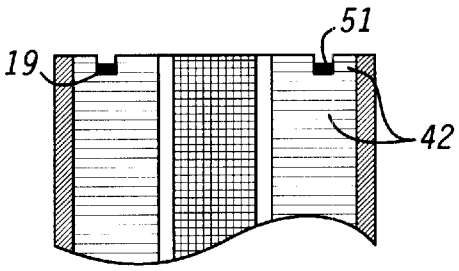
FIG. 7 is a longtitudinal cross-section of the antenna of FIG. 6 along line AB.

A longtitudinal cross-section of embodiment 50 along line 7—7 is shown in FIG. 7. As can be seen in this cross-section, conductive track 19 is beneath insulation medium 42. Uninsulated portion 51 is therefore connectable to one of spring plunger contacts 31,32,33 or 34.

Figure 8:
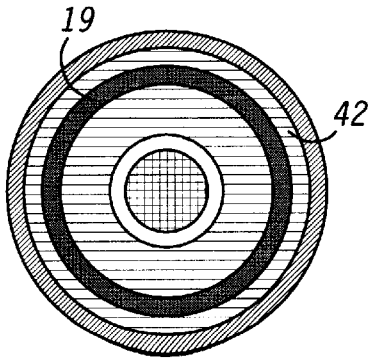
FIG. 8 is a radial cross section showing a conductive track of an antenna for the radio communication device of FIG. 1.

FIG. 8 is a radial cross section showing conductive track 19 when insulation medium 42 is removed.

Implementing the invention requires controller 11 to process code signals when antenna 17 is mounted to antenna mount 12. These code signals are received independent of radiofrequency (RF) signals providing information from other users to a user of device 10. A coding scheme is adopted so that differ embodiments of antenna 17 can provide different coding signals to controller 11. The coding scheme is based on number and location of uninsulated portions on conductive track 19.

Table 1 below shows one example of a coding scheme to identify seven different embodiments of antenna 17. This coding scheme is based on three bits of information provided using electrical contacts 20,21,22.

TABLE 1

Coding Scheme for Three Electrical Contacts

| Bit 2 | Bit 1 | Bit 0 |
|---|---|---|
| 0 | 0 | 0 |
| 0 | 0 | 1 |
| 0 | 1 | 0 |
| 0 | 1 | 1 |
| 1 | 0 | 0 |
| 1 | 0 | 1 |
| 1 | 1 | 0 |
| 1 | 1 | 1 |

In the preferred embodiment as shown in FIG. 2, signal lines 'Bit 0', 'Bit 1' and 'Bit 2' are tied to voltage bias supply 14. By selectively pulling these signal lines low when antenna 17 is mounted, controller 11 can then determine which of the seven different embodiments of antenna 17 has been connected. For example, when embodiment 40 of antenna 17 is connected to antenna mount 12, uninsulated portions 43,44,45,46 are then connected to spring plunger contacts 31,32,33,34 respectively. As a result, all three signal lines are then pulled low because of connection to ground reference 25 via spring plunger contact 34 serving as electrical contact 23. Based on Table 1, a code of "000" is provided to controller 11. Hence, embodiment 40 of antenna 17 is identifed when controller 11 receives the code "000". Embodiment 50 of antenna 17 can be identified when uninsulated portions 51,52 connects to spring plunger contacts 31,34. Spring plunger contacts 31,34 represent electrical contacts 20,23 respectively. Thus connected, signal line 'Bit 2' is pulled low to a value of "0". Hence, embodiment 50 is detected when a code of "011" is received by controller 11.

Figure 9:
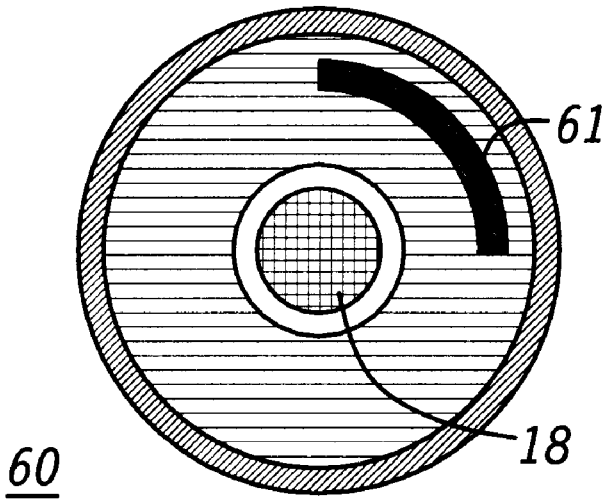
FIGS. 9 and 10 are radial cross-sections showing alternate embodiments of the conductive track for the antenna of FIG. 8.
Figure 10:
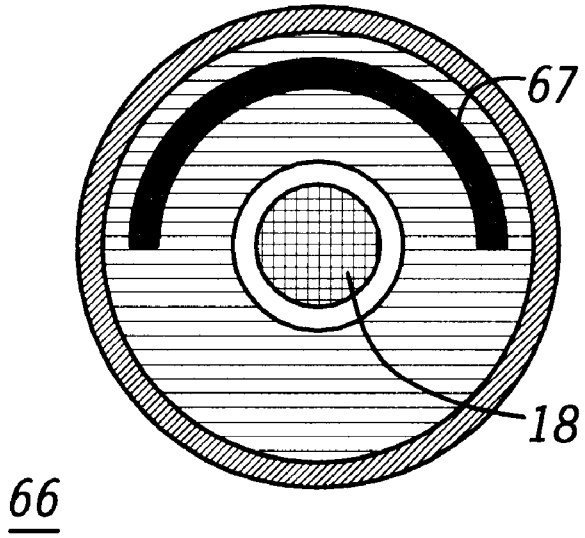

Although the preferred embodiment of the invention is described above with conductive track 19 being insulated with insulation medium 42, alternate embodiments where conductive track 19 is fabricated to provide either larger uninsulated portions or is smaller than that shown in FIG. 8 are shown in FIGS. 9 and 10.

For example, in alternate embodiment 60 as shown in FIG. 9, conductive track 19 is an arcuate portion 61. FIG. 10 shows alternate embodiment 65 with a semicircular portion 66 for conductive track 19. These portions 61, 66 can be uninsulated portions of conductive track 19 as shown in FIG. 8 so that remaining portion of conductive track is insulated and therefore hidden from view. Alternatively, these portions 61,66 are fabricated as shown.

Accordingly, contact housing 30 is modified to accomodate these alternate embodiments 60,65 and provide signal coupling between controller 11 and antenna mount 12. It is to be noted that one of the electrical contacts on contact housing 30 needs to remain at a fixed location for connecting to reference voltage source 13. Remaining electrical contacts in these alternate embodiments 60,65 can then vary so long as connection to the electrical contact to reference voltage source 13 is possible.

With the preferred embodiment and the alternate embodiments as described above, controller 11 controls annunicator 16 to provide an indicating signal for users of device 10 to know whether antenna 17 is appropriately selected or properly connected. When a wrong antenna 17 is selected or improperly connected, an alert signal can be provided to the users. Consequently, controller 11 can stop transmissions out from transceiver circuitry 15.

Advantageously, the invention enables antenna 17 to be identified in accordance with the coding scheme using electrical contacts 20,21,22,23 of antenna mount 12 so that problems of mismatch conditions due to antenna 17 can be alleviated. With antenna 17 being fabricated with a conductive track 19 to thereby provide an indication when mounted to antenna mount 12, damage to sensitive components of transceiver 15 is avoided. Furthermore, users are less likely to perceive incorrectly that device 10 is faulty as a result of these mismatch conditions.

We claim:

1. A radio communication device, comprising:

a controller;

a transmitter coupled to said controller; and an antenna mount having a plurality of contacts, at least one of said electrical contacts being coupled to said controller and at least one other of said electrical contacts being coupled to a reference voltage, wherein said electrical contacts provide a signal indicative of an incorrect antenna selection of an antenna mounted to said mount, and wherein upon receipt of said signal indicating incorrect antenna selection said controller disallows transmission of radio frequency signals by said transmitter.

2. The radio communication device as claimed in claim 1, and further comprising said antenna mounted to said mount, said antenna having at least one conductive track for connecting to at least one of said electrical contacts.

3. The radio communication device as claimed in claim 1, wherein said reference voltage is a ground reference.

4. The radio communication device as claimed in claim 1, further including an annunciator coupled to said controller, wherein upon receipt of said signal indicating incorrect antenna selection said controller activates said annunciator to provide an alert signal to a user indicating that antenna is incorrectly selected.

5. The radio communication device as claimed in claim 1, wherein said electrical contacts also provide a signal indicative of antenna omission from said antenna mount.

* * * * *